US008648754B2

(12) United States Patent
Kim et al.

(10) Patent No.: US 8,648,754 B2
(45) Date of Patent: Feb. 11, 2014

(54) MULTI-RESONANT BROADBAND ANTENNA

(75) Inventors: Hae-soo Kim, Suwon-si (KR); Il-kyu Kim, Seongnam-si (KR); Yong-jun Lim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 593 days.

(21) Appl. No.: 12/533,122

(22) Filed: Jul. 31, 2009

(65) Prior Publication Data

US 2010/0207821 A1 Aug. 19, 2010

(30) Foreign Application Priority Data

Feb. 18, 2009 (KR) ..... 10-2009-0013502

(51) Int. Cl.

| | |
|---|---|
| ***H01Q 1/36*** | (2006.01) |
| ***H01Q 9/42*** | (2006.01) |
| ***H01Q 5/01*** | (2006.01) |
| ***H01Q 21/30*** | (2006.01) |

(52) U.S. Cl.
USPC ..... 343/729; 343/702; 343/806; 343/895

(58) Field of Classification Search
USPC ..... 343/702, 806, 825–831, 700 MS, 729, 343/895
See application file for complete search history.

(56) References Cited

U.S. PATENT DOCUMENTS

| | | | | |
|---|---|---|---|---|
| 3,231,894 | A * | 1/1966 | Nagai | 343/806 |
| 4,381,566 | A * | 4/1983 | Kane | 455/193.3 |
| 6,677,905 | B2 * | 1/2004 | Deguchi et al. | 343/702 |
| 6,946,997 | B2 * | 9/2005 | Yuanzhu | 343/700 MS |
| 7,696,950 | B2 * | 4/2010 | Tsai et al. | 343/893 |
| 2009/0079655 | A1 | 3/2009 | Kim et al. | |

FOREIGN PATENT DOCUMENTS

KR 10-2009-0031123 3/2009

* cited by examiner

*Primary Examiner* — Michael C Wimer
(74) *Attorney, Agent, or Firm* — Staas & Halsey LLP

(57) ABSTRACT

An antenna including: a conducting wire part which includes a first part extending in a first direction, a second part extending from an end of the first part in a direction crossing the first direction, and a third part extending from an end of the second part to face the first part, wherein lengths of the first and third parts are different from each other.

6 Claims, 6 Drawing Sheets

MULTI-RESONANT BROADBAND ANTENNA

CROSS-REFERENCE TO RELATED APPLICATIONS

This application claims the benefit of Korean Patent Application No. 10-2009-0013502, filed on Feb. 18, 2009, in the Korean Intellectual Property Office, the disclosure of which is incorporated herein in its entirety by reference.

BACKGROUND OF THE INVENTION

1. Field of the Invention

An aspect of the present invention relates to a multi-resonant broadband antenna.

2. Description of the Related Art

An antenna is a device that converts electric signals expressed as a voltage or a current into electromagnetic waves or electromagnetic waves expressed as an electric field or a magnetic field into electric signals. Antennas operate in a specific frequency band. For example, an antenna converts electric signals in a radio frequency band into electromagnetic waves and transmits the electromagnetic waves or converts electromagnetic waves into electric signals in a radio frequency band. Such antenna is widely used for radiotelegraphy systems for radio and television broadcasting, wireless local area network (WLAN) two-way communication devices, and radars and radio telescopes for space exploration. Antennas mainly are operated on ground, in air, or outer space, and even underwater or underground, although in these cases antenna operation is limited.

An antenna is a physical arrangement of conductors which generate an electromagnetic field in response to an applied voltage and the corresponding modulated current. Otherwise, a current and a voltage are induced between ends of the antenna in response to an electromagnetic field.

Examples of antennas include a dipole antenna, a monopole antenna, a patch antenna, a horn antenna, a parabolic antenna, a helical antenna, a slot antenna, etc. A monopole antenna or a patch antenna, which can be made small, has been mainly used for small-sized electronic equipment.

SUMMARY OF THE INVENTION

An aspect of the present invention provides a multi-resonant broadband antenna.

According to an aspect of the present invention, there is provided an antenna including a conducting wire part which includes a first part extending in a first direction, a second part extending from an end of the first part in a direction crossing the first direction, and a third part extending from an end of the second part to face the first part, wherein lengths of the first and third parts are different from each other.

According to another aspect of the present invention, the antenna may further include a feeder which is connected to an end of the conductor wire part to supply power to the conductor wire part.

According to another aspect of the present invention, the first and third parts may be formed in meander lines.

According to another aspect of the present invention, the meander line of the first part may overlap the meander line of the third part in a direction in which the first and third parts are orthogonal to each other.

According to another aspect of the present invention, the meander line of the first part may overlap the meander line of the third part in the first direction.

According to another aspect of the present invention, a width between the meander lines of the first and third parts overlapping each other in the first direction may be adjusted.

According to another aspect of the present invention, the antenna may further include another antenna which has a frequency band different from a frequency band of the antenna and is connected to an end of the conducting wire part.

According to another aspect of the present invention, the antenna may be a monopole antenna.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
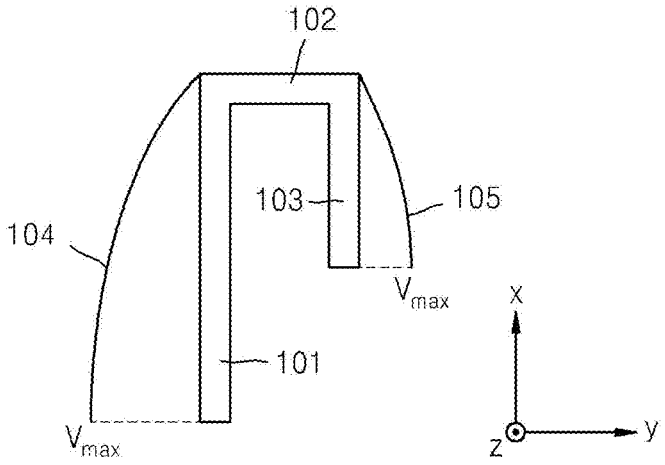
FIG. 1 illustrates a monopole antenna according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 illustrates a monopole antenna according to an embodiment of the present invention.

A monopole antenna, differently from a general half-wavelength dipole antenna, is an antenna which is grounded to a device and has a length of $\lambda/4$. A whip monopole antenna is generally installed in a mobile communication personal portable terminal. A terminal of the whip monopole antenna is grounded in order to reduce a length of the antenna.

The monopole antenna shown in FIG. 1 includes a conducting wire part having parts which are bent at predetermined points. The conducting wire part includes first, second, and third parts 101, 102, and 103. The first part 101 extends in a first direction, e.g., an x-direction. The second part 102 extends from an end of the first part 101 in a direction crossing the first direction, e.g., a y-direction orthogonal to the first direction. The third part 103 extends from an end of the second part 102 to face the first part 101. As shown in FIG. 1, the second part 102 and the first part 101 or the third part 103 do not need to be orthogonal to each other. The first and third parts 101 and 103 may be parallel with each other in a z-direction. The conducting wire part of the antenna may be bent to reduce a size of the monopole antenna. For example, a conventional monopole antenna having a frequency band of 900 MHz requires a resonance length of 84 mm or more. The monopole antenna according to an embodiment of the present invention may have a resonance length of 30 mm. Thus, the monopole antenna of the present embodiment may be used in a small wireless device due to its reduced size. Lengths of the first part 101 and the third part 103 are different from each other. A voltage distribution 104 of the first part 101 and a voltage distribution 105 of the third part 103 are shown in FIG. 1. Although not shown in FIG. 1, the monopole antenna may further include a feeder which is connected to an end of the conducting wire part to supply power to the conducting wire part.

Figure 2:
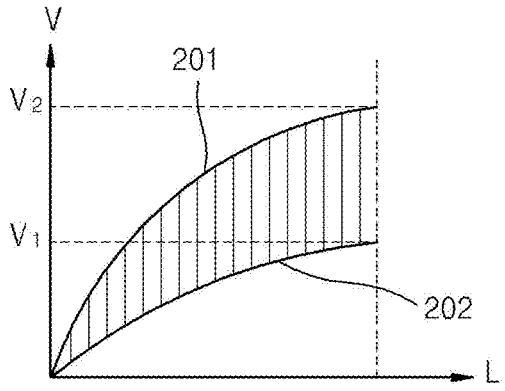
FIG. 2 is a graph illustrating a difference between voltage distributions of parts of the antenna of FIG. 1, according to an embodiment of the present invention.

FIG. 2 is a graph illustrating a difference between voltage distributions of parts of the monopole antenna of FIG. 1, according to an embodiment of the present invention. Since the first and third parts 101 and 103 have different lengths, the voltage distribution 201 of the first part 101 is different from the voltage distribution 202 of the third part 103. A shunt capacitance or a parallel capacitance is formed due to such asymmetric voltage distribution. The shunt capacitance leads to forming of a resonant frequency different from an initial resonant frequency of the monopole antenna. In other words, the monopole antenna has a duplex resonant frequency. Resonance refers to a structural or electrical frequency selection phenomenon. An end of the monopole antenna resonates at a specific frequency to form an electromagnetic signal to be emitted to the outside.

Figure 3A:
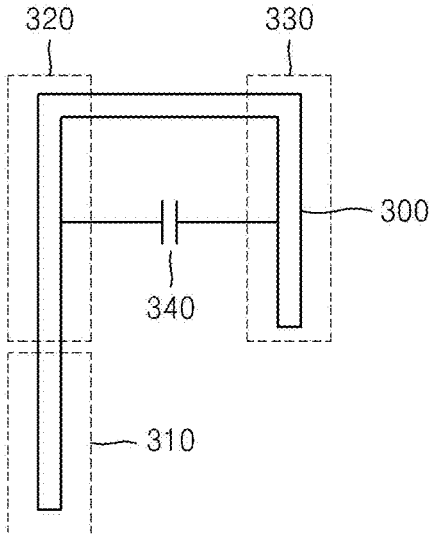
FIGS. 3A and 3B respectively illustrate an equivalent circuit of the antenna of FIG. 1, according to an embodiment of the present invention.
Figure 3B:
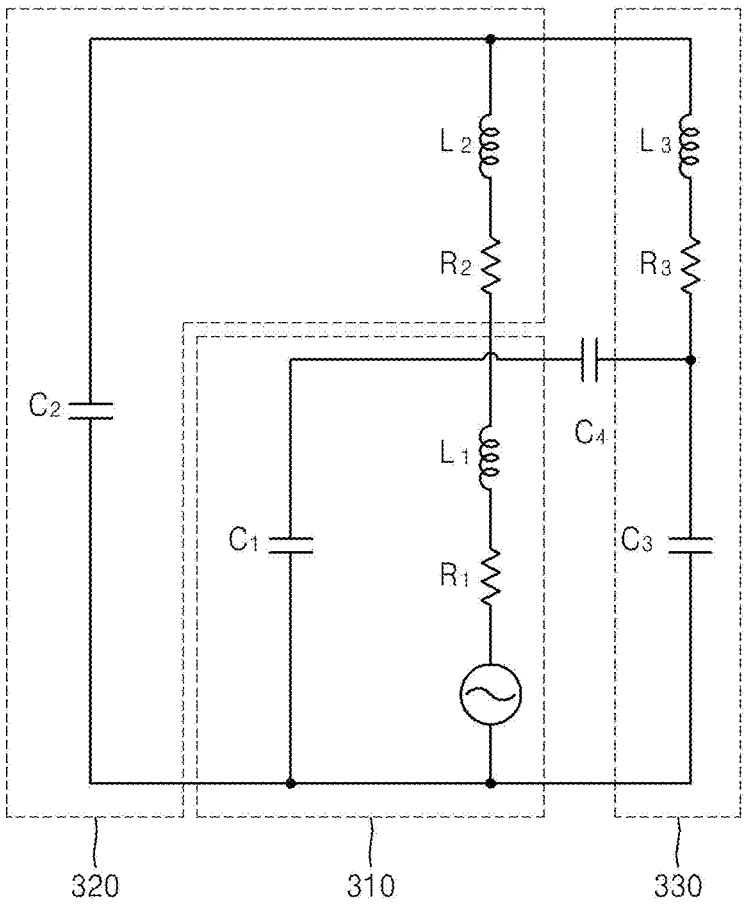

FIGS. 3A and 3B respectively illustrate an equivalent circuit of the monopole antenna of FIG. 1, according to an embodiment of the present invention. Referring to FIG. 3A, a shunt capacitor 340 is generated at a conducting wire part 300 of the monopole antenna of FIG. 1. An equivalent circuit of the monopole antenna of FIG. 1 is shown in FIG. 3B.

Although not shown in the Figs, inductors and capacitors are connected to one another in the equivalent circuit of a general antenna. A resonant frequency refers to a frequency where the magnetic energy and electric energy are equal to each other.

Equation 1 below expresses the magnetic energy of the equivalent circuit of the general antenna:

$$W_m=0.25\cdot|I|^2\cdot L. \tag{1}$$

Equation 2 below expresses the electric energy of the equivalent circuit of the general antenna:

$$W_e = 0.25\cdot|I|^2\cdot\frac{1}{\omega^2\cdot C}. \tag{2}$$

In Equations 1 and 2, "L" denotes an inductance, "C" denotes a capacitance, "ω" denotes a frequency, and "I" denotes a current flowing between an inductor and a capacitor. Since the frequency where the magnetic energy and the electric energy become equal to each other is the resonant frequency, a resonant frequency "$\omega_o$" given by Equation 3 may be obtained from Equations 1 and 2.

$$\omega_o = \frac{1}{\sqrt{L\cdot C}} \tag{3}$$

Figure 4A:
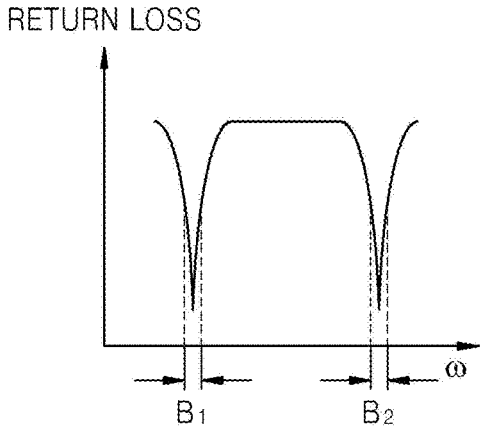
FIGS. 4A through 4C are graphs illustrating a resonant frequency with respect to a shunt capacitance according to embodiments of the present invention.
Figure 4B:
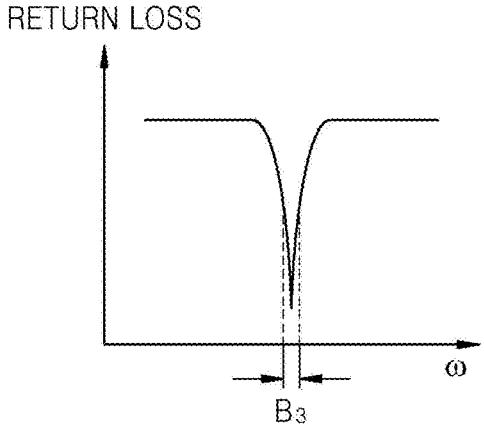
Figure 4C:
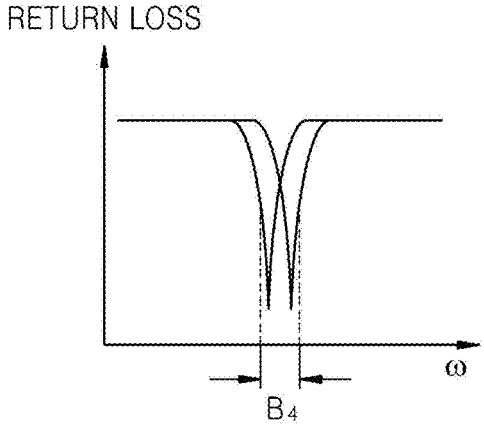

FIG. 3B illustrates a concrete equivalent circuit of the monopole antenna of FIG. 3A. Parts 310, 320, and 330 of the monopole antenna of FIG. 3A are respectively expressed in the equivalent circuit of FIG. 3B, so that each of the parts 310, 320, and 330 includes a resistor "R," an inductor "L," and a capacitor "C." A resonant frequency may be obtained from the equivalent circuit of FIG. 3B. In this case, the total electric energy in the equivalent circuit of FIG. 3B corresponds to a value obtained by adding the electric energy of a shunt capacitor "$C_4$" to the electric energy obtained in Equation 2. As a result, an antenna having two resonant peaks as shown in FIGS. 4A through 4C may be realized.

The electric energy of a shunt capacitor is expressed as in Equation 4 below:

$$W'_e=0.25\cdot|b\cdot I|^2\cdot\omega^2\cdot C_4 \tag{4}$$

wherein "b" denotes a constant, and "$C_4$" denotes a capacitance of the shunt capacitor. Even in this case, a frequency where the electric energy is equal to the magnetic energy is a resonant frequency. In other words, $W_m=W_e+W'_e$. Thus, the resonant frequency where the electric energy is equal to the magnetic energy is obtained as in Equation 5 below:

$$C_4\cdot A\cdot\omega_o^4+B\cdot\omega_o^2+D=0 \tag{5}$$

wherein "A," "B," and "D" denote constants, and "$C_4$" denotes a capacitance of a shunt capacitor. Thus, according to Equation 5, the monopole antenna of the present embodiment has two values of the resonant frequency "$\omega_o$."

FIGS. 4A through 4C are graphs illustrating resonant frequencies with respect to a shunt capacitance according to embodiments of the present invention.

FIG. 4A is a graph illustrating two resonant frequencies. "$B_1$" and $B_2$" denote bandwidth in resonant frequency bands. FIG. 4B is a graph illustrating a resonant frequency when a shunt capacitance is "0." In this case, the antenna has only one resonant frequency. FIG. 4C is a graph illustrating two resonant frequencies when a shunt capacitance "C4" represented by an overlapping degree between the first and third parts 101 and 103 of the monopole antenna has a small value. In this case, values of resonant frequencies are approximately adjacent to each other. If the shunt capacitance "C4" has a very small value, two resonant frequencies are approximately equal to each other. If the shunt capacitance "$C_4$" is adjusted to an arbitrary value through tuning, the values of the resonant frequencies overlap with each other. Thus, the antenna has a broaden bandwidth. In FIG. 4C, a bandwidth "B4" is larger than a bandwidth shown in FIG. 4A or 4B. Thus, a narrowband problem of a small-sized conventional radio device or antenna may be solved. The monopole antenna of the present invention may be used for a device using a High Speed Downlink Packet Access (HSDPA) service band, a Global System for Mobile Communications (GSM) band, and the like. In this case, a capacitance may be adjusted so that two resonant peaks formed by adjusting the length of the third part 103 of the conducting wire part of FIG. 1 overlap each other, thereby enlarging the bandwidth. Also, the monopole antenna according to one embodiment of the present invention may be formed in a meander shape to have a small size. A small-sized monopole antenna generally has a narrow frequency band. However, since an overlapping width between meander lines of the first and third parts 101 and 103 may be adjusted, a multi-narrowband frequency in an appropriate frequency band may be increased to a broadband frequency.

Figure 5:
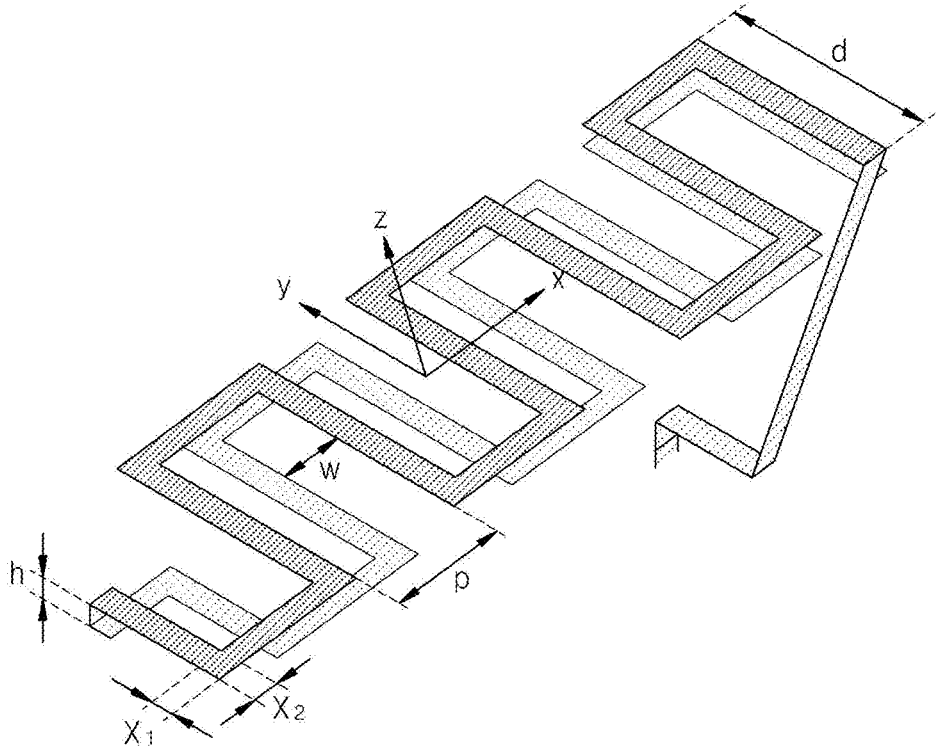
FIG. 5 illustrates an antenna according to another embodiment of the present invention.

FIG. 5 illustrates an antenna according to another embodiment of the present invention. Referring to FIG. 5, the first and third parts 101 and 103 of the monopole antenna of FIG. 1 are formed into meander lines. A part of the antenna of FIG.

5 having a height "h" corresponds to the second part 102 of FIG. 1. The meander shape of the antenna of FIG. 5 includes several sections each having a ⊏ shape formed by bending an antenna element. A meander line corresponding to the first part 101 is referred to as an upper meander line, and a meander line corresponding to the third part 103 is referred to as a lower meander line. A pitch "p" between meander sections may be equal to a distance "d" of each of the meander sections. Also, widths "x1" and "x2" of each of the meander lines may be equal to each other. If a total length of the upper meander line is different from a total length of the lower meander line, a shunt capacitance is generated by an asymmetric voltage distribution, so that another resonant frequency is generated.

According to another aspect of the present invention, the upper meander lines may be shifted from the lower meander lines along a x direction. That is, a y-direction meander section of the upper meander line may be shifted from a y-direction meander section of the lower meander line along an x direction. A width "w" between the y-direction meander sections of the upper and lower meander lines may be adjusted, thereby enlarging a bandwidth as shown in FIG. 4C.

Figure 6:
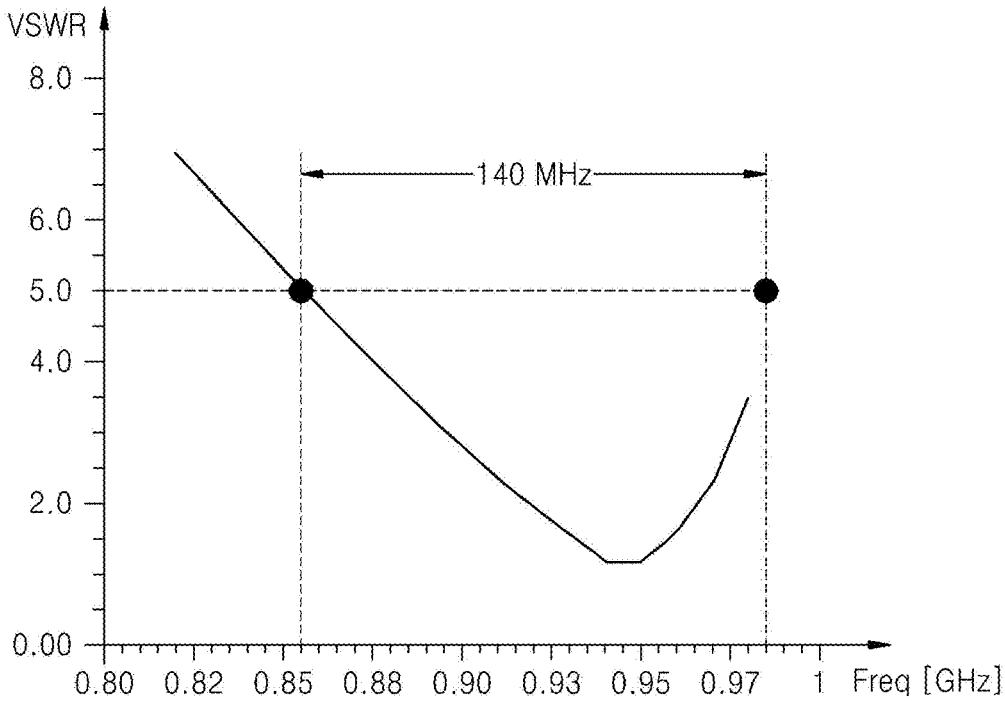
FIG. 6 is a graph illustrating a bandwidth of an antenna according to an embodiment of the present invention.

FIG. 6 is a graph illustrating a bandwidth of an antenna according to an embodiment of the present invention. Referring to FIG. 6, if a resonant frequency of the antenna is "900 MHz," and a voltage standing wave ratio (VSWR) is "5.0," a bandwidth of about 140 MHz may be obtained. The general antenna having the resonant frequency of 900 MHz has a bandwidth of about 120 MHz. Thus, the bandwidth may be further increased by about 15%.

Figure 7A:
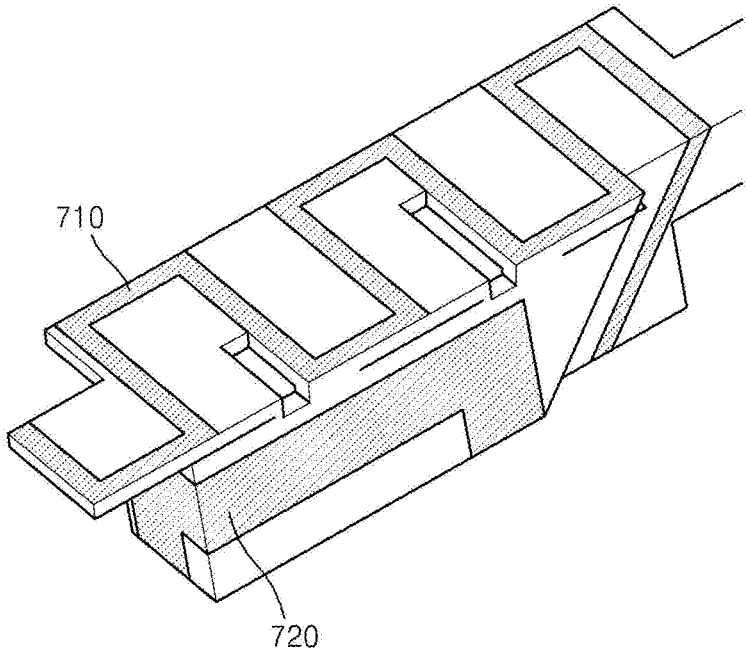
FIGS. 7A and 7B illustrate an antenna according to another embodiment of the present invention.
Figure 7B:
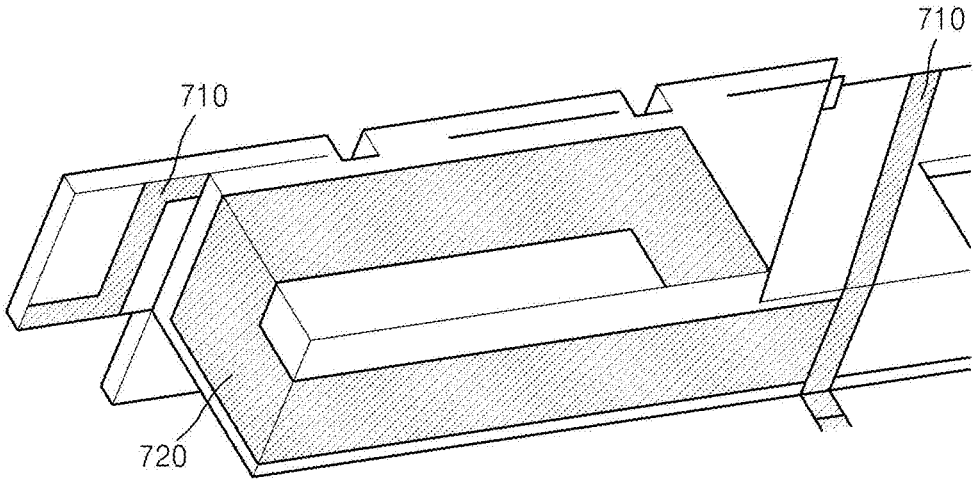

FIGS. 7A and 7B illustrate an antenna according to another embodiment of the present invention. Referring to FIGS. 7A and 7B, an antenna 720 having a different frequency band from that of an antenna 710 is connected to the antenna 710. If a frequency band of the antenna 710 is 900 MHz, for example, the antenna 720 may have a frequency band of 2 GHz. In this case, several service bands may be supported. Also, the antenna 720 may be formed in the same shape as the antenna of FIG. 1 or FIG. 5 so as to broaden a frequency band. Thus, a bandwidth of each of the several service bands may be broadened. The antenna of the present embodiment may support several service bands such as HSDPA, m-WIMax, and the like and may be used in several mobile devices, thereby improving the degree of mobility.

While this invention has been particularly shown and described with reference to embodiments thereof, it will be understood by those skilled in the art that various changes in form and details may be made therein without departing from the spirit and scope of the invention as defined by the appended claims. The embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. An antenna having a conducting wire part comprising:

a first part extending in a first direction;

a second part extending from an end of the first part in a second direction perpendicular to the first direction; and a third part extending from an end of the second part in the first direction to face the first part and being parallel to the first part, and the first part and the third part being separated by a length of the second part, wherein lengths of the first and third parts are different from each other, the first and third parts are formed in meander lines, the meander line of the first part having the same shape, pitch, and meander width as the third part, the meander line of the first part are offset in the first direction from the meander line of the third part, wherein the meander line of the first part is shifted from the meander line of the third part along the first direction to control a capacitance between the first part and the third part, by a shift width, which is a distance between sections of the meander line of the first and third parts in the first direction, and wherein the antenna attaches electrically to a device at an end of the first part opposite to the end of the first part where the second part is attached.

2. The antenna of claim 1, wherein another antenna is connected to an end of the conducting wire part of the antenna, and has a frequency band different from a frequency band of the antenna.

3. The antenna of claim 1, wherein the antenna is a monopole antenna.

4. The antenna of claim 1, wherein a pitch between meander sections is equal to a distance of each of the meander sections.

5. The antenna of claim 1, wherein the shift width between sections of the meander lines of the first and third parts is adjusted in order to change a capacitance between the first and third parts and a bandwidth of the antenna.

6. The antenna of claim 3, wherein the monopole antenna has a duplex resonant frequency.

* * * * *